United States Patent [19]

Takuo

[11] 4,442,050

[45] Apr. 10, 1984

[54] SPRAY METHOD OF APPLYING MONOLITHIC REFRACTORY MATERIAL

[75] Inventor: Hosaka Takuo, Toyota, Japan

[73] Assignee: Nippon Crucible Co., Ltd., Tokyo, Japan

[21] Appl. No.: 67,890

[22] PCT Filed: Dec. 19, 1978

[86] PCT No.: PCT/JP78/00060

§ 371 Date: Aug. 20, 1979

§ 102(e) Date: Aug. 20, 1979

[87] PCT Pub. No.: WO79/00442

PCT Pub. Date: Jul. 26, 1979

[30] Foreign Application Priority Data

Dec. 21, 1977 [JP] Japan ..... 52-153868

[51] Int. Cl.[3] ..... F27D 1/16

[52] U.S. Cl. ..... 264/30

[58] Field of Search ..... 264/30

[56] References Cited

U.S. PATENT DOCUMENTS 3,672,649 6/1972 Allen ..... 264/30 X 4,039,175 8/1977 Beckers ..... 264/30 X

*Primary Examiner*—Thomas P. Pavelko

*Attorney, Agent, or Firm*—Robert E. Burns; Emmanuel J. Lobato; Bruce L. Adams

[57] ABSTRACT

Improvements in the method of applying monolithic refractory material by spraying wherein, the work surface to be lined is surrounded by a screening member such as wire nettings having suitable air escape openings, and the refractory material is sprayed within the surrounding to form a lining.

Material loss due to scattering may be minimized and the work environment may be substantially improved by virtue of the screening member, and a rigid and strong refractory lining of required thickness can be obtained.

5 Claims, 1 Drawing Figure

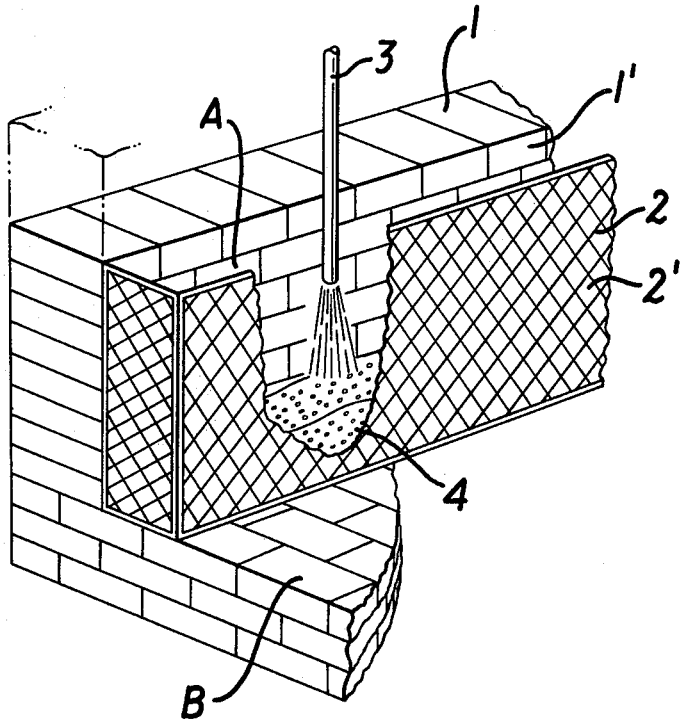
1
1'
3
A
2
2'
4
B

SPRAY METHOD OF APPLYING MONOLITHIC REFRACTORY MATERIAL

FIELD OF THE INVENTION

This invention relates to improvements in the method of applying monolithic refractory material by spraying. The method is adaptable for the construction and repair of industrial and metallurgical furnaces, and like refractory equipments.

BACKGROUND OF THE INVENTION

Conventionally, the method of spraying refractory material has been used only for lining the inside of small constructions such as chimneys and ducts. However, recently, the method has been used for the installation of industrial furnaces, in which the whole of the lining is formed by spraying monolithic refractory material.

The spraying of the material is generally conducted at room temperature, but in the course of recent repairing of industrial and metallurgical furnaces the tendency has been to spray refractory material while the furnace is still hot, as it is considered unfavorable and a loss of time to stop and cool the furnace for repairing merely a partly worn portion.

Spraying of monolithic refractory material has two kinds of processes, i.e. a dry process and a wet process. In the dry process, the powdered material is transmitted from the container to the nozzle by compressed air in a dry state through a hose, then mixed with water and sprayed. In the wet process, the powdered material is mixed with water in the container and sent to the nozzle in a muddy state, and sprayed by the compressed air.

In either process, however, the refractory material is sprayed through the nozzle which is spaced apart from an opposed work surface, and the material is forced to adhere to the surface by collision. As a result, some of the material may rebound or be carried away by the air stream, and such causes loss of the material. The loss becomes particularly large when material is applied to a vertical wall or a ceiling, and sometimes amounts to about 10% of the material used. Further, once the material is hydrated, it cannot be reused, so that, this kind of loss is considered to be a limitation to the development of the spray method.

The conventional spray method also has the following disadvantages.

(a) Rebounding material scatters around as dust, and injures the work environment.

(b) As the material is sprayed on the work surface layer by layer to form a lining, the lining easily peels off when it exceeds a certain thickness.

This limit of the thickness is about 100–120 mm. As a matter of fact, use of the spray method is restricted to merely repair of locally worn portions, because of this thickness limit.

SUMMARY OF THE INVENTION

In accordance with the method of the present invention, the work surface to be lined is surrounded with a screening member such as wire nettings, having openings which permit the air to escape but which openings are small enough to prevent the escape of the refractory material when it is sprayed. The screening member is disposed a distance away from the work surface to form a space therebetween, and the distance approximately corresponds to the required thickness of the lining to be formed. The refractory material is sprayed in the space through a nozzle disposed within the space and generally parallel, i.e., in a parallel or slightly inclined relationship, with the work surface.

While air in the sprayed mass escape through the openings of the screening member, refractory material may be seized therein and piled up in the space to form a lining. Particles of sprayed material coagulate with each other and adhere to the work surface while the stickiness of the material is still retained.

According to the method of the present invention, not only the material loss as mentioned above may be minimized, but the work environment may be substantially improved because of the decrease of scattering of material. Further, it enables increase of the thickness of the lining, because the peeling of the lining is prevented as will be mentioned below in the detailed descriptions.

BRIEF DESCRIPTION OF THE DRAWING

The drawing is a perspective view of a portion of a refractory construction, illustrating the process of the present invention.

DESCRIPTION OF THE PREFERRED EMBODIMENT

In the drawing, numeral 1 shows a portion of the brick work of a refractory construction, and 1' is a work surface to be lined with refractory material.

The work surface 1' is surrounded with a screening member 2 such as wire nettings having air escape openings 2'.

The screening member 2 is disposed a certain distance from the work surface 1' to form a space A, which approximately corresponds to the required thickness of the lining.

The material is sprayed into the space A through nozzle 3, which is preferably positioned in a parallel or slightly declined relationship with the work surface 1'. The sprayed material 4 is piled up gradually in the space A on the bottom surface B of the brick work 1. Loss of the material and the amount of scattered dust decrease substantially, by virtue of filtering action of the screening member 2. The sprayed material particles seized within the screening member 2 and piled up in the space A, will coagulate with each other and adhere to the work surface within a short time while the stickiness of the material is still retained and form lining on the work surface 1'.

Peeling of the boundary surface between layers may be prevented, and even if it may occur, a boundary surface may be disposed vertical to the work surface 1', and not parallel as in the conventional spray method, because the spray direction is parallel to the work surface 1', so that the peeling of the lining is minimized and a strong and rigid lining may be obtained.

In the case of working on the vertical wall having no bottom surface, a screening member of finer mesh, i.e. smaller size openings, or a plate may be used to support the formed lining, and when the wall is comparatively high, the screening member may be extended upward with the progress of the spraying.

Wire nettings, gratings or lattice made of metal, plastics or wood may be used for the screening member, and a suitable supporting member may be also used to support the screening member.

The screening member may be fixed on the working portion and removed after the lining is completed. In some cases, the screening member may be left on the working place, and allowed to melt or burn at the high temperature of furnace operation. Sometimes, the screening member may be adpated to move with the nozzle.

The size of the opening of the screening member may be decided according to the viscosity of spraying material, spraying pressure, etc. within the range of about 5–100 mm, but excessively large size openings may increase the loss of material, and if the opening is too small the adhesive strength of the lining may be decreased because escaping of the air becomes difficult. The spray method of the present invention has following advantages:

(a) As described above, the loss of material is minimized, and the work environment is improved due to the prevention of material scattering.

(b) A lining of the required thickness can be obtained easily by a relatively simple operation with a simple device. Spraying may be conducted easily even in a hot work environment because of this simple operation.

(c) A lining of required shape may be obtained by using a screening member of required shape.

(d) The screening member is relatively light and can be moved and positioned very easily.

I claim:

1. A method of applying a monolithic refractory material to a work surface, comprising:

providing a screen having openings dimensioned to permit the flow of air therethrough and to effectively prevent the passage therethrough of refractory material which is to be applied to a work surface;

positioning the screen so as to substantially enclose the work surface such that a major portion of the screen is spaced a selected distance from the work surface to define between the work surface and the major portion of the screen a space having a thickness approximately corresponding to the thickness of the refractory material to be applied; and spraying by compressed air a refractory material in the space between the work surface and the screen in a direction generally parallel relative to the work surface to progressively accumulate refractory material in the space between the screen and the work surface while permitting the air to escape through the screen openings both below and above the level of the accumulated refractory material to thereby form a layer of refractory material on the work surface free from trapped air.

2. A method of applying a monolithic material according to claim 1, wherein the step of spraying the refractory material comprises the refractory material through a nozzle oriented with a direction of spray parallel to the work surface.

3. A method of applying a monolithic material according to claim 1, wherein the step of spraying the refractory material comprises spraying the refractory material through a nozzle oriented with a direction of spray slightly inclined to the work surface.

4. A method of applying a monolithic material according to claim 1, wherein the sizes of the screen openings are selected according to the viscosity of the refractory material being sprayed so as to allow the escape of air through the screen from within the space between the screen and the work surface and to prevent the escape of the sprayed refractory material through the screen.

5. A method of applying a monolithic material according to claim 14, wherein the sizes of the screen openings range from about 5 to 100 millimeters.

* * * * *